United States Patent [19]

Mankouski

[11] 4,030,302

[45] June 21, 1977

[54] STEAM POWER PLANT

[76] Inventor: Peter Mankouski, 90-16 54th Ave., Elmhurst, N.Y. 11373

[22] Filed: Apr. 6, 1976

[21] Appl. No.: 674,164

Related U.S. Application Data

[63] Continuation-in-part of Ser. No. 596,601, July 17, 1975, abandoned.

[52] U.S. Cl. ..... 60/667; 60/654; 60/686; 60/688; 122/37; 122/442

[51] Int. Cl.[2] ..... F01K 7/38; F22D 1/32

[58] Field of Search ..... 60/654, 664, 665, 667, 60/686, 688, 689, 691; 122/37, 156, 442

[56] References Cited

UNITED STATES PATENTS

| | | | |
|---|---|---|---|
| 786,122 | 3/1905 | Hess | 60/664 |
| 991,765 | 5/1911 | Waterman | 122/156 |
| 1,078,623 | 11/1913 | Jones et al. | 122/442 |
| 1,960,914 | 5/1934 | McCoy | 122/442 |
| 3,977,198 | 8/1976 | Berry | 122/37 X |

*Primary Examiner*—Allen M. Ostrager
*Assistant Examiner*—Stephen F. Husar
*Attorney, Agent, or Firm*—Lane, Aitken, Dunner & Ziems

[57] ABSTRACT

In a steam engine, an intermediate phase is provided for preheating the feedwater before it enters the boiler. The preheating is achieved by means of the reapplication of the otherwise dispensable exhaust steam in a simple feedback operation in which the exhaust steam is introduced directly into the feedwater. By means of electronic controls the operation of the system at the highest possible point of preheat (up to 210° F.) is achieved thus assuring both high efficiency of the machine and cumulative economy in fuel consumption as well. The latter is further augmented by generous application of insulation to prevent wasteful dissipation of thermal energy as well as to effect protection of the system against the elements.

8 Claims, 1 Drawing Figure

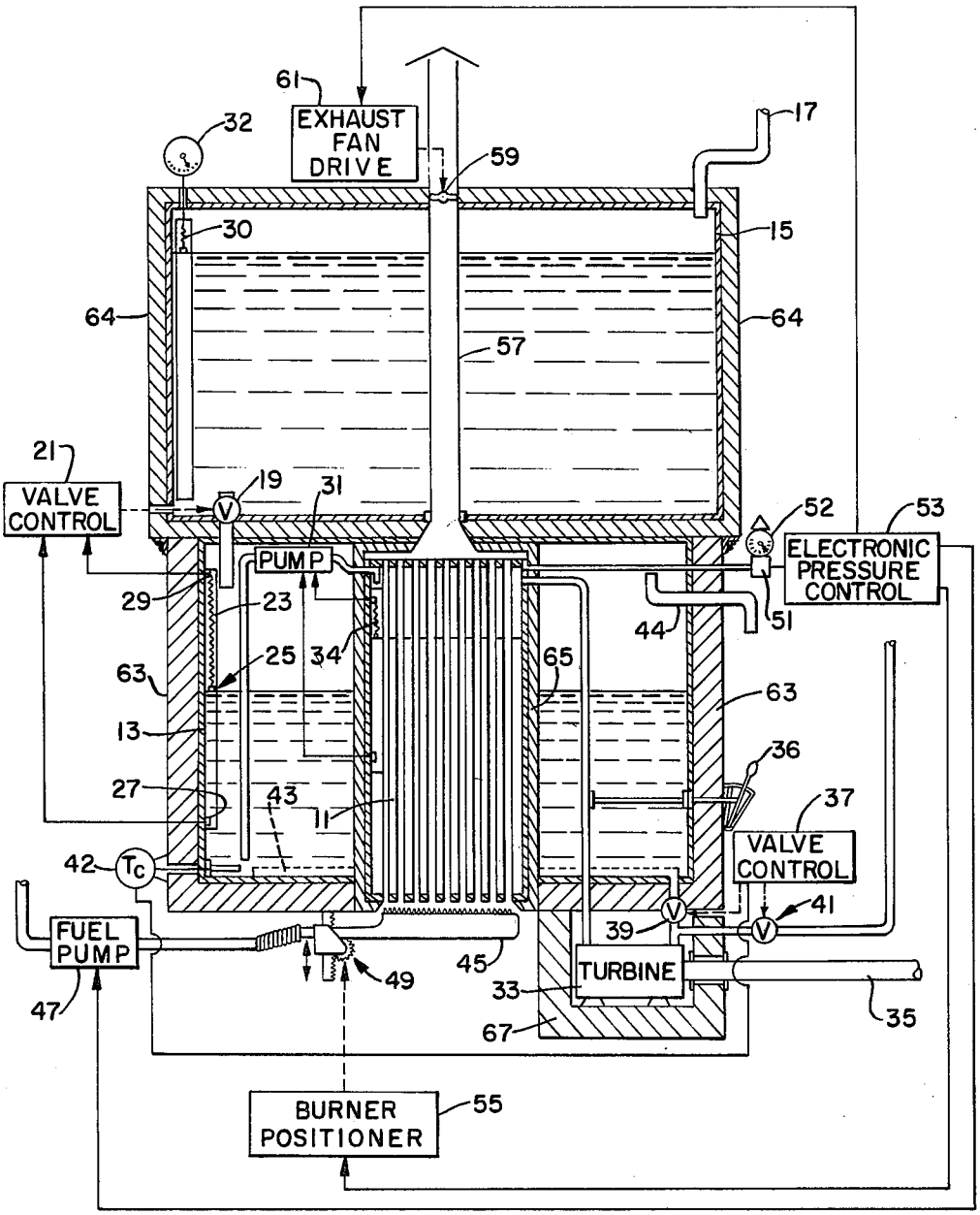
EXHAUST FAN DRIVE
VALVE CONTROL
PUMP
ELECTRONIC PRESSURE CONTROL
VALVE CONTROL
FUEL PUMP
TURBINE
BURNER POSITIONER
61
32
59
17
30
15
64
64
57
21
19
31
52
53
29
23
44
51
25
34
65
63
63
13
36
27
43
11
37
42
Tc
41
39
45
49
33
35
47
67
55

STEAM POWER PLANT

REFERENCE TO RELATED APPLICATIONS

This application is a continuation-in-part of application Ser. No. 596,601 filed July 17, 1975 now abandoned entitled "HIGH EFFICIENCY STEAM ENGINE PEGASUS I".

SUMMARY OF THE INVENTION

In accordance with the present invention a special low pressure feedwater tank is provided surrounding the boiler of the steam engine. Whenever the temperature of the feedwater is below a predetermined minimum, the exhaust steam from the boiler is introduced directly into the bottom of the feedwater tank to preheat the feedwater up to just below boiling. The exhaust steam from the boiler is introduced into the feedwater by means of a pipe coiled around the bottom of the feedwater tank in several turns and provided with apertures through which the exhaust steam is allowed to bubble into the feedwater tank. When the feedwater has been heated to a temperature just below boiling, the exhaust steam is released into the atmosphere bypassing the feedwater tank. The fuel to the burner for the boiler and the position of the burner relative to the boiler is controlled automatically in response to boiler pressure which changes with the fluctuations in the level of workload demand.

The steam engine, thus, is of simple construction that achieves high efficiency and an economy in fuel consumption as well as minimum environmental pollution and operating noise with full safety of operation.

BRIEF DESCRIPTION OF THE DRAWING

The single FIGURE of the drawings is a schematic illustration of the steam engine system of the present invention.

DESCRIPTION OF THE PREFERRED EMBODIMENT

As shown in the drawings, the steam engine of the present invention comprises a high pressure boiler 11 surrounded by a low pressure feedwater tank 13. Supported on top of the boiler 11 and feedwater tank 13 is a low pressure water storage tank 15.

Rainwater, which should be used in this system whenever possible, is supplied through a pipe 17 into the storage tank 15. Cold water may be caused to flow from the tank 15 through a valve 19 into the low pressure feedwater tank 13. The valve 19 is controlled by a valve control 21 in response to the water level in the tank 13. A water level detector 23 is provided in the tank 13 comprising a float 25, a lower limit detector 27, and an upper limit detector 29. When the water level in the tank 13 drops to the lower limit level, the float 25 will come adjacent to the detector 27, which will then send a signal to the valve control 21. In response to this signal, the valve control 21 will open the valve 19 and allow cold water to flow from the tank 15 by gravity into the tank 13. Water will then continue flowing into the tank 13 until the tank 13 becomes filled, at which time the float 25 will come adjacent to the upper limit sensor 29. The upper limit sensor will then send to the valve control 21 a signal, in response to which the valve control 21 will close the valve 19. The water level in the tank 15 is sensed by a water level detector 30 and indicated by a meter 32.

In the tank 13, the water is kept at temperatures ranging from 205° to 210° F., that is just below the boiling point. From the tank 13, preheated water is pumped into the boiler 11 by a high pressure pump 31. The pump 31 is controlled to keep an adequate level of water in the boiler 11 in response to a water level detector 34, similar to the detector 23, in the boiler 11. In the boiler 11, the water is speedily converted into steam and enters a turbine 33 driving a revolving output shaft 35. The rate of flow of steam from the boiler to the turbine is controlled by a throttle 36. The decompressed exhaust steam from the turbine has two paths out of the system. If the temperature in the tank 13 drops below 205° F., a valve control 37 comes into action opening the valve 39 and closing the valve 41 so that the exhaust steam from the turbine will enter a long open ended pipe 43 which is coiled in several turns around the boiler in the bottom of the tank 13. The pipe 43 is replete with small holes throughout its length and the exhaust steam enters directly into the water in the tank 13 through the holes in the pipe 43 and rapidly dissipates raising the water temperature in the tank 13 and adding to the water volume. Any overflow of water is discharged through a pipe 44. When the water temperature reaches 210° F., the valve control 37 will move the valve 39 back into its closed position and open the valve 41 letting steam out into the atmosphere surrounding the steam engine, or, if desired, into a condenser for returning the condensed steam back into the storage tank 15. It is only at the point at which the water in tank 13 has been heated up to 210° and the valve 41 is opened and the valve 39 is closed that the system loses thermal energy. However, such loss occurs with minimal expense and fuel consumption. Instead of having to heat cold water from about 60° up to about 215° or a full 155°, heating of only 5° to 10° is required. The valve control 37 controls the valves 39 and 41 to open and close in response to the temperature in the tank 13 by means of a thermocouple 42 which senses the temperature in the tank 13 and applies a signal to the valve control 37 representing the temperature.

If desired, the heat energy in the exhausted steam may be recovered and used to provide heat for the building in which the steam engine is located.

To enable the engine to respond to variable demand, the engine has been furnished with a special kind of fuel burner 45, which has an adjustable position with respect to the boiler 11 and which has a regulated fuel supply provided by an electronically controlled fuel pump 47. The burner can be moved up or down, closer or further from the boiler, by means of a drive 49 depending on the workload that the machine experiences at any given instant. The workload demand is reflected in changes of the steam pressure in the boiler, which is sensed and converted into an electric signal representing the pressure by a pressure monitoring device 51. The present monitoring device 51 includes a pressure meter 52 to indicate the pressure in the boiler. The pressure monitoring device 51 also functions as a safety valve for the boiler 11. Any change in the boiler pressure due to a change in workload demand for steam is promptly communicated by the device 51 to an electronic pressure control 53 which controls the fuel pump 47 and a burner positioner 55. The burner positioner 55, which may be a conventional servo mechanism, operates the drive 49 to position the burner at a position corresponding to the signal received from the electronic pressure control 53 and thus corresponding to the pressure sensed by the pressure monitoring device 51. If the boiler pressure drops, the control 53 will cause the fuel pump 47 to increase the fuel flow rate to the burner 45 and at the same time cause the burner positioner 55 to lower the burner 45 so that the higher burner flame will be properly positioned relative to the boiler 11. Conversely, when the boiler pressure increases, the control 53 will cause the fuel pump 47 to decrease the fuel flow rate to the burner 45 and at the same time cause the burner positioner 55 to raise the burner 45. Control of the fuel flow rate in this manner effectively diminishes the danger of a boiler blowup. Combustion products from the boiler are drawn out through a stack 57, which passes up through the middle of the tank 15, by means of a fan 59, which is driven by a variable speed fan drive 61. The fan drive 61 is controlled by the electronic pressure control 53, which will apply a signal to the fan drive 61 to cause it to operate at a higher speed in response to lower boiler pressure signalled by the pressure monitoring device 51 and at lower speeds in response to higher boiler pressure signalled by the device 51. Thus, when the burner flame is increased in response to lower boiler pressure, the exhaust fan speed will be increased to handle the increased combustion products and also to draw increased air flow to the burner for combustion.

Rather heavy insulation 63, 64, 65 and 67 is applied to the water tanks 13 and 15, the boiler 11 and the turbine 33, respectively. The insulation serves to reduce the dissipation of heat from the system and provides protection against severe environmental temperature to which the system might be subjected.

The above described engine is of relatively simple, low cost construction, and yet it achieves high efficiency and high economy in fuel consumption with very little environmental pollution or operating noise and full safety of operation.

I claim:

1. A steam engine comprising a boiler for converting water to steam, a feedwater tank, means for pumping water from said feedwater tank to said boiler, a steam driven prime mover connected to receive and be driven by the steam generated in said boiler, valve means operable in a first condition to direct exhaust steam from said prime mover directly into the water in said feedwater tank at the bottom thereof and operable in a second condition to dump the exhaust steam from said prime mover externally of said feedwater tank, and means responsive to the temperature in said feedwater tank to control said valve means switching said valve means to said first condition whenever the temperature in said feedwater tank falls below a first predetermined temperature and switching said valve means to said second condition whenever the temperature in said feedwater tank rises above a second predetermined temperature greater than said first predetermined temperature.

2. A steam engine as recited in claim 1, wherein there is provided a burner positioned beneath said boiler, and means to control the rate of fuel flow to said burner in response to the pressure in said boiler increasing the rate of fuel flow in response to lower pressures in said boiler and decreasing the rate of fuel flow in response to higher pressures in said boiler.

3. A steam engine as recited in claim 2, wherein there is provided means to raise and lower said burner in response to pressure in said boiler lowering said burner in response to lower pressures in said boiler and raising said burner in response to higher pressures in said boiler.

4. A steam engine as recited in claim 3, wherein there is provided means to exhaust the combustion products from said burner after passing through said boiler including a fan and means to vary the speed of said fan in response to the pressure in said boiler increasing the speed of said fan in response to lower pressures in said boiler and decreasing the speed of said fan in response to higher pressures in said boiler.

5. A steam engine as recited in claim 1, wherein said feedwater tank surrounds said boiler.

6. A steam engine as recited in claim 5, wherein there is provided a pipe coiled in the bottom of said feedwater tank and having apertures distributed along its length and wherein said exhaust steam is introduced into said feedwater tank via said pipe.

7. A steam engine as recited in claim 3, wherein there is provided a water storage tank and means responsive to the level of water in said feedwater tank to supply water to said feedwater tank from said water storage tank.

8. A steam engine as recited in claim 5, wherein insulation is provided surrounding said boiler between said boiler and said feedwater tank and insulation is provided surrounding said feedwater tank.

* * * * *